United States Patent [19]

Tanaka et al.

[11] 4,295,806

[45] Oct. 20, 1981

[54] ROTARY COMPRESSOR WITH WIRE GAUZE LUBRICANT SEPARATOR

[75] Inventors: Naoki Tanaka, Amagasaki; Kunihiko Tsuchiya; Toshizo Nishizawa, both of Shizuoka, all of Japan

[73] Assignee: Mitsubishi Denki Kabushiki Kaisha, Tokyo, Japan

[21] Appl. No.: 34,009

[22] Filed: Apr. 27, 1979

[30] Foreign Application Priority Data

May 26, 1978 [JP] Japan ..... 53/63088
Dec. 29, 1978 [JP] Japan ..... 53/179398[U]

[51] Int. Cl.[3] ..... F04C 29/02; B01D 50/00

[52] U.S. Cl. ..... 418/97; 418/DIG. 1; 55/320

[58] Field of Search ..... 418/93, 97–100, 418/DIG. 1; 55/320; 62/470, 473

[56] References Cited

U.S. PATENT DOCUMENTS

| | | | |
|---|---|---|---|
| Re. 27,691 | 7/1973 | Harlin et al. | 418/97 |
| 3,030,754 | 4/1962 | Root et al. | 55/320 |
| 3,480,204 | 11/1969 | Harlin | 418/99 |
| 3,684,412 | 8/1972 | Harlin et al. | 418/97 |
| 3,721,069 | 3/1973 | Walker | 55/320 |
| 3,743,453 | 7/1973 | Abendschein | 418/97 |
| 3,820,923 | 6/1974 | Zweifel | 418/99 |
| 3,820,924 | 6/1974 | Cassidy | 418/97 |
| 3,989,490 | 11/1976 | Adalbert et al. | 418/99 |
| 4,135,865 | 1/1979 | Takada | 418/DIG. 1 |

OTHER PUBLICATIONS

Tothero, D. L. et al., *A Rotary Vane Compressor for Automotive Air Conditioning Applications,* Proceedings of the Purdue Compressor Technology Conference, Jul. 19–21, 1978, pp. 226–232.

*Primary Examiner*—John J. Vrablik
*Attorney, Agent, or Firm*—Wenderoth, Lind & Ponack

[57] ABSTRACT

The disclosed rotary compressor includes a wire gauze disposed in its shell to traverse a passage through which a compressed gaseous refrigerant from a delivery tube flows to a discharge tube within the shell. A lubricant included in the compressed refrigerant is separated from the latter by the wire gauze and falls on a sump disposed at the bottom of the housing. Further an L roof-shaped partition may be interposed between the top of a compressor unit and the housing to divide a space around the compressor unit into two space portions in which the delivery and discharge tubes open respectively.

8 Claims, 8 Drawing Figures

ROTARY COMPRESSOR WITH WIRE GAUZE LUBRICANT SEPARATOR

BACKGROUND OF THE INVENTION

This invention relates to a rotary compressor, and more particularly to improvements in a separator for separating lubricating oil from a gaseous refrigerant delivered into a shell for a rotary compressor.

Rotary compressors are used in home refrigerators or home air conditioners because rotary compressors can be made in small sizes. In rotary compressors of the type referred to, however, compressed refrigerant delivered from the compression chamber thereof includes a large amount of lubricant. Feeding the compressed refrigerant including the lubricant to an associated refrigerating cycle causes a decrease in refrigerating capacity and therefore should be avoided as much as possible. To this end, conventional rotary compressors have included a separator disposed on the outside of the housing therefor to separate the lubricant from the refrigerant. Alternatively, the internal space within the shell itself can be large so that the lubricant will be spontaneously separated from the gaseous refrigerant during passage of the mixed refrigerant and lubricant through the large space. The former measure is expensive because of the provision of an additional part while the latter measure has led to the necessity of making the shell itself large-sized resulting in expensive or heavy compressors. Alternatively, the resulting compressors have not been adapted to be made in small issues.

Accordingly, it is an object of the present invention to provide a rotary compressor including a new and improved separator for separating a lubricant from a gaseous refrigerant mixed with the latter inexpensively and efficiently and without using large-sized equipment.

SUMMARY OF THE INVENTION

The present invention provides a rotary compressor comprising a shell including a lubricant sump disposed at the bottom thereof, a compressor unit disposed within the shell to compress a gaseous refrigerant, a delivery tube connected to the main body of the compressor unit to deliver the compressed refrigerant to the space within the shell, a discharge tube connected to the shell to discharge the compressed refrigerant from the space within the shell to the exterior of the shell and wire gauze disposed between the delivery tube and the discharge tube in the space within the shell to separate the lubricant from the compressed refrigerant, the separated lubricant being returned to the lubricant sump.

In order to increase the degree of separation of the lubricant, the wire gauze may be disposed within the shell perpendicular to the longitudinal axis of the shell and traverse fully the space within the shell thereby to divide the space into a first space and a second space, and a partition is disposed in the first space to divide the first space into a pair of space portions, the delivery tube opening into one of the space portions, and the discharge tube opening into the other space portion.

The partition is preferably in the form of a roof having the L-shaped cross section including a central portion fixedly secured to a portion of an inner peripheral surface of the shell located in the vicinity of the top of the compressor unit and both ends abutting against portions of an outer wall of the compressor unit adjacent to the top thereof.

BRIEF DESCRIPTION OF THE DRAWING

The present invention will become more readily apparent from the following detailed description taken in conjunction with the accompanying drawing in which.

DESCRIPTION OF THE PREFERRED EMBODIMENTS

Figure 1:
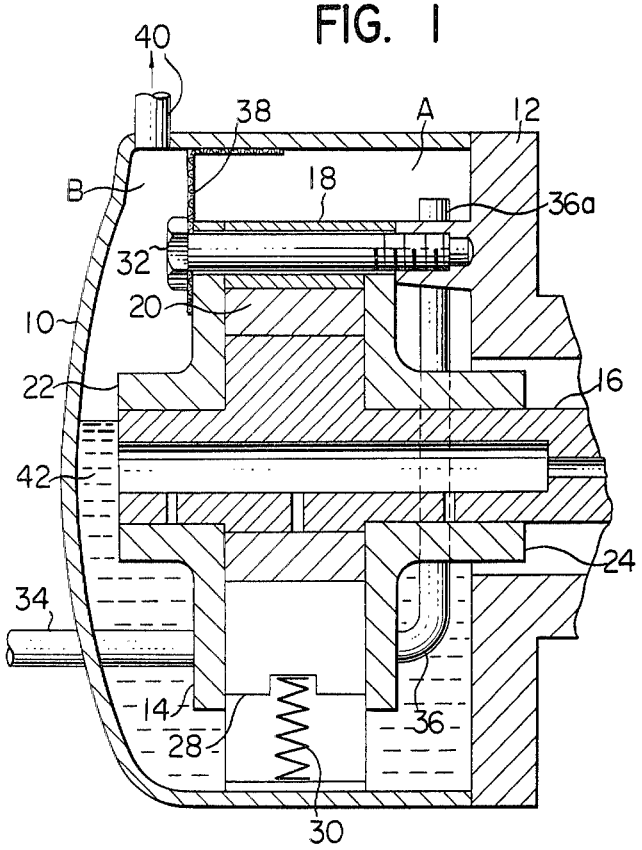
FIG. 1 is a fragmental sectional side elevational view of a rotary compressor according to the present invention.

Referring now to FIG. 1 of the drawings, there is illustrated a rotary compressor according to the present invention. The arrangement illustrated comprises a horizontally disposed shell 10 in the form of a hollow cylinder having one end closed, a cover plate 12 fixedly secured in sealing relationship to the other open end of the housing 10 such as by welding, and a compressor unit generally designated by the reference numeral 14 disposed within the space defined by the shell 10 and the cover plate 12. The compressor unit 14 includes a crank shaft 16, a cylinder 18, a rolling piston 20, a pair of opposite side shells 22 and 24, a vane 28 and a vane spring 30 disposed as shown in FIG. 1. The compressor unit 14 is fixedly secured to the cover plate 12 by a plurality of fastening bolts 32 only one of which is illustrated. The components of the compressor unit 14 are well known and form no part of the present invention so that they are not further described herein.

A suction tube 34 for a gaseous refrigerant extends through and is sealed in the closed end of the shell 10 and opens into the interior of the compressor unit 14, and a delivery tube 36 extends from the lower portion, as viewed in FIG. 1, of the main body of the compressor unit 14 and opens in the upper portion, as viewed in FIG. 1, of the space within the housing 10 adjacent to the cover plate 12. A wire gauze 38 is disposed within the shell 10 adjacent to the closed end with one edge fastened to the side shell 22 by the fastening bolts 32 and the other edge folded and fixedly secured to the inner cylindrical surface of the housing 10.

Further a discharge tube 40 extends from that portion of the cylindrical surface connected to the closed end of the housing to the exterior thereof, that is, to a condenser (not shown).

Also a lubricant sump 42 is disposed in the bottom of the shell 10 and has an oil level located somewhat above the longitudinal axis of the shell 10 and leaving an internal space thereabove divided into a first and a second space A and B respectively by the wire gauze 38. The outlet **36*a* of the delivery tube 36 is positioned in the first space A above the oil level of the sump 42 and the discharge tube 40** extends from the second space B.

In operation, a gaseous refrigerant from an evaporator (not shown) is sucked into the compressor unit 14 through the suction tube 34. The gaseous refrigerant is compressed in the compressor unit 14 and the compressed refrigerant is delivered to the first space A in the shell 10 through the delivery tube 36. Then the compressed refrigerant from the first space A passes through the wire gauze 38 and then enters the second space B. Thereafter the compressed refrigerant is discharged to the condenser (not shown) through the discharge tube 40.

It will readily be understood that when compressed, the refrigerant may be mixed with the lubricant within the compressor unit 14 so that the compressed refrigerant entering the first space A may include a large amount of the lubricant. When the mixed refrigerant and lubricant passes through the wire gauze 38, the lubricant is separated from the refrigerant and then goes along the wire gauze 38 and the side shell 22 by the action of the gravity until it is returned to the sump 42. On the other hand, the refrigerant separated from the lubricant is introduced into and occupies the second space B from which the discharge tube 40 extends. Thus the wire gauze 38 serves as an oil separator for separating the lubricant from the mixture. Also as a matter of course the lubricant is prevented from being discharged to the condenser (not shown). This prevents a decrease in refrigerating capacity due to the lubricant entering the refrigerant.

Figure 2:
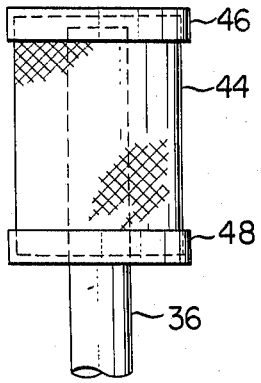
FIG. 2 is a side elevational view of a modification of the oil separator of the present invention shown in FIG. 1.
Figure 3:
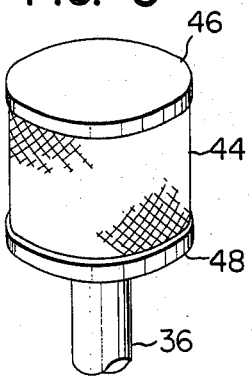
FIG. 3 is a perspective view of the arrangement shown in FIG. 2.

In the arrangement of FIG. 1, the oil separator is formed of the wire gauze 38 fixedly secured to the compressor unit 14 and the shell 10 to divide the interior of the shell 10 into the first and second spaces A and B respectively, but the oil separator can alternatively have a structure as shown in FIGS. 2 and 3. In the arrangement illustrated a cylindrical wire gauze 4 is positioned so as to encircle coaxially the outlet 36*a* of the delivery tube 36 and it is closed at the upper end as viewed in FIGS. 2 and 3 with an upper tray-shaped cover 46 which is located above the outlet 36*a* with a predetermined size space therebetween. Then a lower annular cover 48 is attached to the lower end of the cylindrical wire gauze 44 around the delivery tube 36.

Therefore the first space A as shown in FIG. 1 corresponds to the space defined by the cylindrical wire gauze 44, that portion of the delivery tube 36 encircled by the gauze 44 and the covers 46 and 48 while the second space B corresponds to a space disposed outside of the cylindrical wire gauze 44.

Since the upper cover 46 is close to the outlet 36*a* of the delivery tube 36 as shown best in FIG. 2, the compressed refrigerant mixed with the lubricant strikes against the upper cover 46 thereby to promote the separation of the lubricant or oil from the gaseous refrigerant. At the same time, the refrigerant with the lubricant changes the direction of its flow to form a uniform stream thereof. Therefore the desired result can be achieved although the space defined by the cylindrical wire gauze 44 and the covers 46 and 48 is relatively small.

Also, in order that the lubricant separated from the refrigerant by the cylindrical wire gauze 44 can go along the lower cover 48 and then return to the sump 42, it is desirable to dispose the whole separator at a position where the lower cover 48 is contacted by the sump 42.

Figure 4:
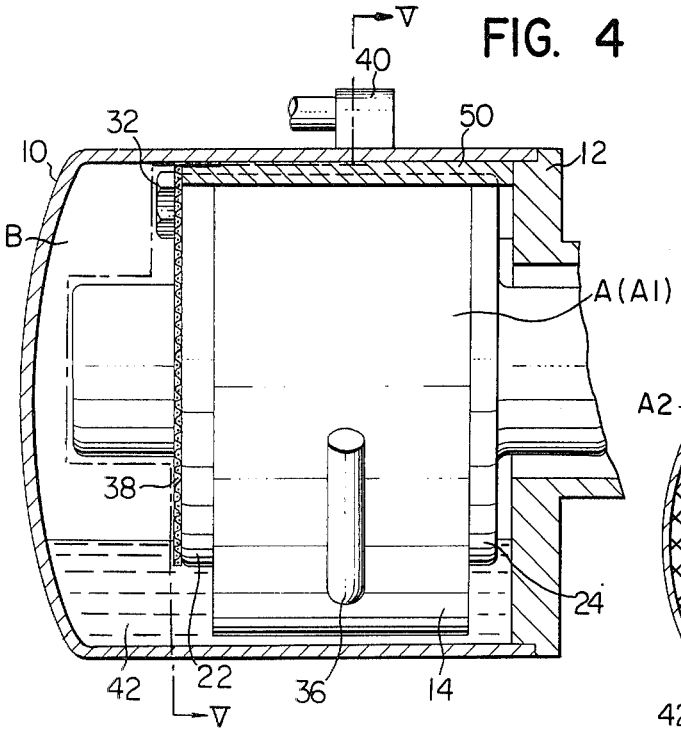
FIG. 4 is a fragmental sectional side elevational view of a modification of the present invention.

In FIG. 4, wherein like reference numerals designate components identical to or corresponding to those shown in FIG. 1, there is illustrated a modification of the present invention intended to increase the extent to which refrigerant is separated from the lubricant. The arrangement illustrated is different from that shown in FIG. 1 principally in that in FIG. 4, the wire gauze cooperates with a partition so as to divide the interior of the housing into three spaces to cause the compressed refrigerant including the lubricant to pass through the wire gauze twice as it flows along a U-shaped path for the purpose of increasing the degree of separation of the lubricant.

More specifically, the wire gauze 38 in the form of a segment of a short cylinder is fixedly secured on the short cylindrical surface to the inner cylindrical surface of the shell 10 and fastened to the side shell 22 by the fastening bolts 32 so that it extends perpendicularly to the longitudinal axis of the shell 10 while contacting the side shell 22. The wire gauze 38 includes a straight edge immersed in the sump 42 located in the bottom portion of the housing 10. Thus the wire gauze 38 is disposed within the shell 10 perpendicular to the longitudinal axis thereof and traverses fully the space within the shell above the sump 42 thereby to divide the latter into a first and a second space A and B respectively.

Figure 5:
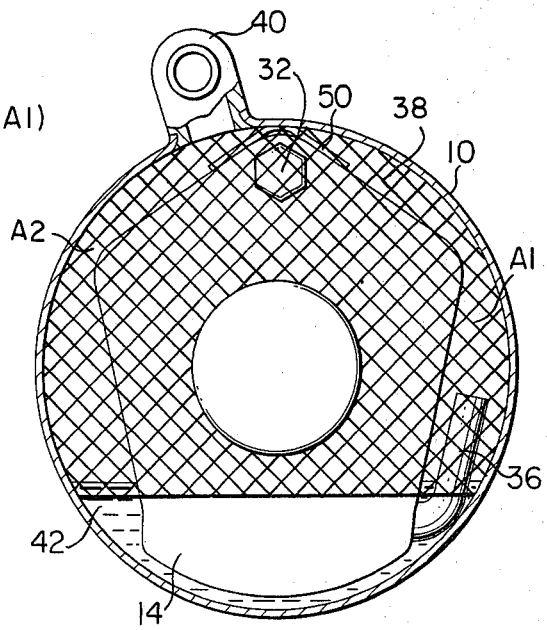
FIG. 5 is a sectional view taken along the line V—V of FIG. 4 with parts omitted.

As best shown in FIG. 5, a partition 50 in the form of a roof having an L-shape cross section is disposed between the top as viewed in FIG. 5 of the compressor unit 14 and the adjacent portion of the inner cylindrical surface of the shell 10. More specifically, the roof-shaped partition 50 extends axially of the housing to the cover plate 12 and includes a central portion fixedly secured to that portion of the inner cylindrical surface of the shell located in the vicinity of the top of the compressor unit 14 and both ends abutting against to those portions of the outer wall adjacent to the top of the compressor unit 14. Therefore the partition 50 divides the first space A into a pair of space portions A1 and A2.

The delivery tube 36 opens into the space portion A1 at a position located above the surface of the lubricant in the sump 42, in this case, located on the lower portion of the shell 10 and the discharge tube 40 is connected in fluid communication with the space portion A2 through a short tube radially outward extending from the inner cylindrical surface of the shell 10 at a position adjacent to the roof-shaped partition 50.

As in the arrangement of FIG. 1, a gaseous refrigerant is drawn into the compressor unit 14 where it is compressed and also mixed with the lubricant from the sump 42. The refrigerant thus compressed and mixed with the lubricant is delivered to the space portion A1 within the shell 10 through the delivery tube 36 and then passed through the wire gauze 38 to enter the second space B. At that time, some of the lubricant included in the compressed refrigerant is separated from the latter by the wire gauze 38 and the separated lubricant falls along the wire gauze 38 until it is returned to the sump 42.

On the other hand, the compressed refrigerant which has entered the first space B again passes through the wire gauze 38 and then flows into the space portion A2. As a result, the refrigerant flows along a U-shaped path within the shell 10. When the refrigerant again passes through the wire gauze 38, the lubricant still included in the refrigerant is separated from the latter by the wire gauze 38 and similarly returned to the sump 42. Therefore the refrigerant entering the space portion A2 is substantially free from the lubricant and discharged via the discharge tube 40 to the exterior of the compressor, in this case, a condenser (not shown).

In the arrangement shown in FIGS. 4 and 5, the refrigerant passes through the wire gauze 38 twice resulting in an increase in degree of separation of the lubricant.

From the foregoing it will be seen that the present invention provides a compact rotary compressor having a simple construction and a high efficiency without decreasing the refrigerating capacity. This is because lubricant mixed with the compressed gaseous refrigerant is separated from the latter by a wire gauze after which only the compressed refrigerant is discharged to an associated condenser while the separated lubricant falls along the wire gauze by the action of the gravity to return to a lubricant sump disposed at the bottom of the housing for the compressor.

Figure 6:
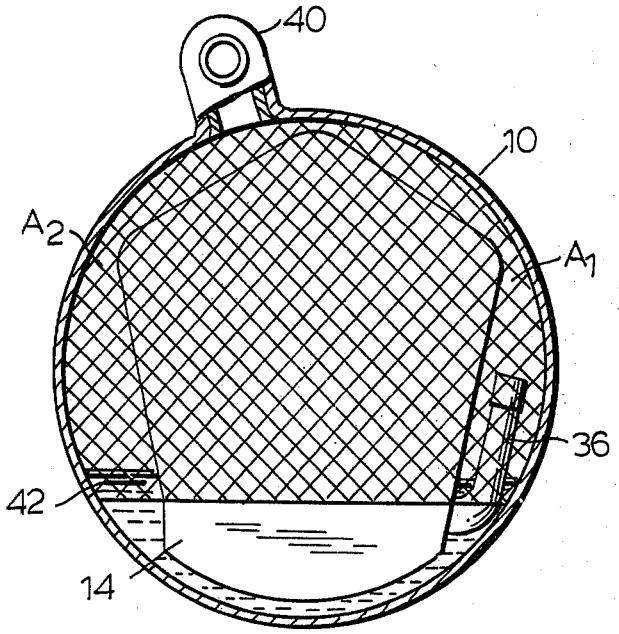
FIGS. 6 and 7 are views similar to FIG. 5 showing further alternative arrangements.
Figure 7:
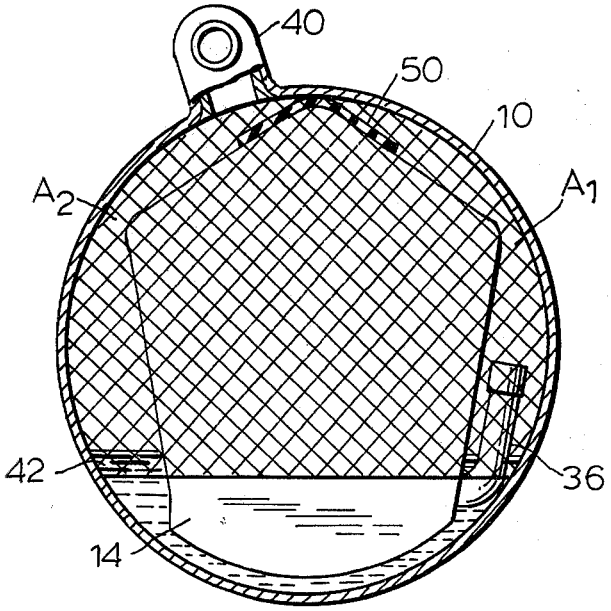
Figure 8:
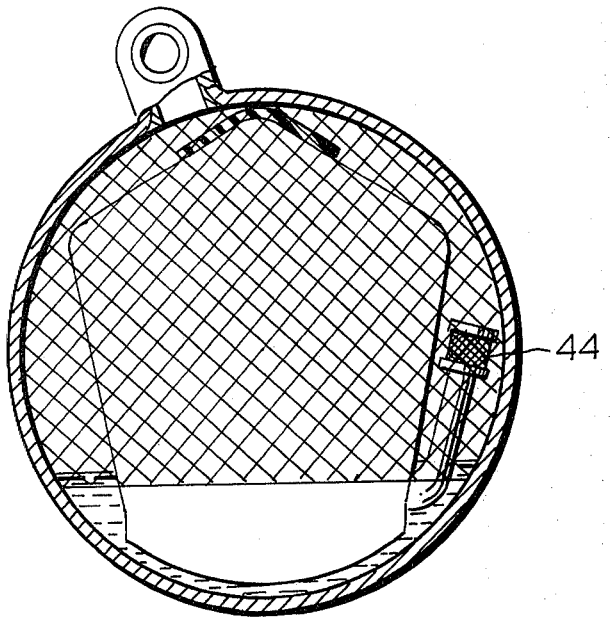
FIG. 8 is a view similar to FIG. 7 showing a still further alternative arrangement.

While the present invention has been illustrated and described in conjunction with a few preferred embodiments thereof it is to be understood that numerous changes and modifications may be resorted to without departing from the spirit and scope of the present invention. For example, the arrangement of FIG. 4 may include, in addition to the wire gauze 38, another wire gauze 44 operatively coupled to the delivery tube 36 as shown in FIG. 8. Also the partition 50 may be formed of a wire gauze as shown in FIG. 7. Further the partition 50 may be omitted, as shown in FIG. 6, provided that the top edge of the compressor unit is spaced from the adjacent portion of the inner peripheral surface of the shell by a small distance and simultaneously the amount of the refrigerant from the space portion A1 directly entering the space portion A2 is sufficiently small as compared with an amount of the refrigerant from the space portion A1 flowing into the first space B.

What we claim is:

1. A rotary compressor comprising: a horizontal cylindrical shell having a lubricant sump disposed at the bottom thereof; a compressor unit mounted within said shell for compressing a gaseous refrigerant, the size of the compressor unit being less than the size of the interior of said shell for leaving a space within said shell; a delivery tube connected to the main body of said compressor unit to deliver the compressed gaseous refrigerant to said space; a discharge tube connected to said shell to discharge the compressed refrigerant from said space to the exterior of said shell; a wire gauze positioned in said space within said shell perpendicular to the longitudinal axis of said shell and extending fully across said space within said shell to a level below the level of lubricant in said sump, thereby dividing said space into a first space containing said compressor unit and a second space, for separating lubricant from the compressed refrigerant and for directing said separated lubricant back to said lubricant sump; and means in said first space for blocking passage of refrigerant between said compressor unit and said shell for dividing the first space into two portions, said delivery tube opening into one of said space portions and said discharge tube opening out of the other space portion, whereby compressed refrigerant is delivered from said delivery tube to said one space portion, passes through the wire guaze to the second space, and then again passes through the wire guaze to said other space portion and said discharge tube

2. A rotary compressor as claimed in claim 1 wherein said means is a partition between said compressor unit and said shell.

3. A rotary compressor as claimed in claim 1 wherein said means is a top edge on said compressor unit spaced from said shell a sufficiently short distance to substantially block flow of refrigerant between said compressor unit and said shell.

4. A rotary compressor as claimed in claim 1 in which said means is a further wire gauze between said compressor unit and said shell.

5. A rotary compressor as claimed in claim 1 further comprising an additional wire gauze in the form of a hollow cylinder encircling the outlet end of said delivery tube.

6. A rotary compressor as claimed in claim 1 wherein said shell has an open end, and said compressor further comprises a cover plate closing the open end of said shell, and a plurality of fastening bolts fixedly securing said compressor unit to said cover plate and said wire gauze to said compressor unit.

7. A rotary compressor as claimed in claim 1 wherein said means is in the form of a roof having an L-shaped cross section and including a central portion fixedly secured to a portion of the inner cylindrical surface of said shell located in the vicinity of the top of said compressor unit and both ends abutting against portions of the outer wall of said compressor unit adjacent said top thereof.

8. A rotary compressor as claimed in claim 7 wherein said shell has an open end, and said compressor further comprises a cover plate closing the open end of said shell, and a plurality of fastening bolts fixedly securing said compressor unit to said cover plate and said wire gauze to said compressor unit.

* * * * *